United States Patent [19]

Moraw et al.

[11] Patent Number: 4,482,242

[45] Date of Patent: Nov. 13, 1984

[54] DEVICE AND METHOD FOR STRIPPING DEVELOPER LIQUID FROM A PHOTOCONDUCTIVE SURFACE

[75] Inventors: Roland Moraw; Guenther Schaedlich, both of Wiesbaden-Naurod, Fed. Rep. of Germany

[73] Assignee: Hoechst Aktiengesellschaft, Frankfurt am Main, Fed. Rep. of Germany

[21] Appl. No.: 482,540

[22] Filed: Apr. 6, 1983

[30] Foreign Application Priority Data

Apr. 15, 1982 [DE] Fed. Rep. of Germany ..... 3213797

[51] Int. Cl.[3] ..... G03G 15/10

[52] U.S. Cl. ..... 355/10; 118/661; 118/662; 355/77; 430/117

[58] Field of Search ..... 355/10, 4, 77; 118/661, 118/662, 261, 413, 414, 647-651; 430/117-119

[56] References Cited

U.S. PATENT DOCUMENTS

| | | | |
|---|---|---|---|
| 4,023,899 | 5/1977 | Hayashi et al. | 355/10 |
| 4,052,959 | 10/1977 | Hayashi et al. | 355/10 X |
| 4,161,361 | 7/1979 | Soma et al. | 355/10 |
| 4,236,483 | 12/1980 | Davis et al. | 430/117 X |
| 4,241,694 | 12/1980 | Cormier et al. | 355/10 X |
| 4,248,522 | 2/1981 | Davis | 355/10 |
| 4,258,115 | 3/1981 | Magome et al. | 430/117 X |
| 4,278,343 | 7/1981 | Kurokawa | 355/10 |
| 4,325,627 | 4/1982 | Swidler et al. | 355/10 |
| 4,353,639 | 10/1982 | Moraw et al. | 355/10 |
| 4,373,800 | 2/1983 | Kamiyama et al. | 355/10 |
| 4,411,976 | 10/1983 | Landa et al. | 420/119 X |

FOREIGN PATENT DOCUMENTS

| | | | |
|---|---|---|---|
| 2558451 | 7/1976 | Fed. Rep. of Germany | 355/10 |
| 0010442 | 1/1978 | Japan | 355/10 |
| 0038134 | 3/1979 | Japan | 355/10 |
| 0088157 | 7/1981 | Japan | 355/10 |
| 0210373 | 12/1982 | Japan | 355/10 |

OTHER PUBLICATIONS

Patent Abstracts of Japan Band 5, No. 157, Oct. 8, 1981 & JP-A-56-89770.

*Primary Examiner*—R. L. Moses

*Attorney, Agent, or Firm*—Schwartz, Jeffery, Schwaab, Mack, Blumenthal & Koch

[57] ABSTRACT

In the method and apparatus of the present invention, a voltage of up to 1,800 V is applied to the photoconductor surface of the drum of an electrophotographic copier. A latent charge image is formed by exposing the photoconductor surface and the latent charge image is developed by contact with a developing liquid to form a toner image. Excess developer is removed by a stripping roller which contacts the drum and rotates at a speed which is up to 20% faster than that of the drum.

23 Claims, 6 Drawing Figures

DEVICE AND METHOD FOR STRIPPING DEVELOPER LIQUID FROM A PHOTOCONDUCTIVE SURFACE

BACKGROUND OF THE INVENTION

1. Field of the Invention

The present invention relates to an electrophotographic copying process in which a photoconductive layer is electrostatically charged and exposed to an information-carrying original. The latent charge-image obtained on the photoconductive layer is developed by means of a developer liquid to obtain a visible toner-image. Excess developer liquid is removed by an element which contacts the photoconductor surface, and the toner-image is transferred by electrophoresis from the photoconductor onto an image-receiving material and is fixed thereon. The photoconductor is then cleaned and/or discharged.

2. Discussion of Related Art

German Offenlegungsschrift No. 3,018,241 discloses a method for removing excess developer liquid from a photoconductive surface on which an electrostatic charge-image has been developed. The developer is composed of a suspension of charged toner-particles in an insulating developer liquid. In the disclosed method, a drying element in the form of a squeegee-roller or absorbent roller is brought into contact with the photoconductive surface. This squeegee-roller or absorbent roller is maintained at a potential having a polarity which is identical to that of the charge on the charged toner particles. In addition, the relative motion between the photoconductive surface and the squeegee-roller or absorbent roller is controlled to be zero in the contact region. The cylindrical surface of the squeegee-roller or absorbent roller is composed of an elastomeric material exhibiting a Shore-A hardness of less than 45 and a resistance value of less than $10^9$ Ohm.cm. The photoconductive surface is located on a drum which runs counterclockwise past a metering roller or stripping roller which is capable of limiting the quantity of liquid remaining on the photoconductor after the development of the latent charge-image. This metering roller or stripping roller does not touch the developed charge-image, so that neither streaks nor distortions are produced. After passing the metering or stripping roller, a layer of developer liquid with a thickness of between 10 and 15 μm remains in the photoconductor surface and the surface of the drum passes over the squeegeeroller or absorbent roller. The bias voltage on the squeegee-roller or absorbent roller produces an electric field which holds the toner firmly on the photoconductor surface. The bias voltage has the same polarity as the toner particles in the developer liquid; thus, the developed image remains adhered to the photoconductor surface without producing streaks or smears and without transfer of toner onto the squeegee-roller. After running past the squeegee-roller, the layer of liquid developer remaining on the photoconductor surface is reduced to a thickness of 2 to 3 μm, so that, overall, the thickness of the layer of developer liquid on the photoconductor is reduced to approximately a fifth of the initial value.

The disclosure of Offenlegungsschrift No. 3,018,241 relating to copy quality is limited to the statement that no traces of dragging, streaks, or distortions should occur in the copy. Nothing is mentioned with regard to achievable copy density, which, particularly in the case of the squeegee-roller technique, is an important consideration since the squeegee-roller also squeezes off a proportion of the toner particles which have been deposited by electrophoresis on the photoconductor. Even if coarse streaks on the copies are avoided, very short streaks at the edges perpendicular to the direction of movement resulting from the squeezing off action adversely affect the edge-sharpness and, in consequence, reduce the resolution which can be achieved.

At the copy quality levels demanded at the present time, the resolution must be approximately six lines per mm, both in the direction of movement and at right angles to this direction, in order to be able to produce first-generation and second-generation copies which are easily readable, from the foregoing copies.

The liquid development technique offers advantages such as high resolution and low energy demand for fixing copies, as compared with the dry development technique. However, this technique also has the disadvantage that during the transfer of the toner image to the image-receiving material, the residual developer liquid which has not been squeezed off by the squeegee-roller is deposited on the image-receiving material and has to be evaporated by heating the copies during the fixing step. As a result, large quantities of developer liquid are lost and must be continually completed to the copier, and the air in the vicinity of the copier becomes undesirably laden with evaporated developer liquid. Although the customary developer liquids are not toxic per se, since in the majority of cases, they are aliphatic hydrocarbons such as i-decane in which the charged toner particles are dispersed, this large loss of developer liquid is undesirable because it leads to a certain level of environmental pollution.

In the present state of the art as described, for example in U.S. Pat. No. 3,907,423, the loss of developer liquid following the development of the charge-image on the photoconductive layer by electrophoretic deposition of charged toner particles is reduced by reducing the excess, projecting thickness of the layer of developer liquid. This reduction in thickness is carried out before the toner image is transferred to the image receiving material by a stripping roller rotating counter to the rotation of the photoconductor. The stripping roller rotates at a high peripheral speed counter to the movement of the photoconductive layer at a distance of only approximately 50 μm from it. The toner-images deposited on the photoconductive layer are not smeared; however, only a portion of the projecting quantity of developer liquid is removed, so that moist copies are discharged.

Up until very recently, repeated attempts have been made to remove recess developer liquid from the photoconductor surface after the development of the electrostatic charge-image to effect a further reduction in the loss of developer liquid to the copies. In these attempts, both absorbent rollers made of a foamed polymer with open pores and squeegee-rollers have been employed. The squeegee-roller technique is described, for example, in U.S. Pat. No. 3,299,787. This patent discloses the use of a squeegee-roller with an associated cleaning element for removing the excess developer liquid from a photoconductive web.

In the present state of the art, there is a disadvantage in that when photoconductive drums coated with selenium are used, the toner-images developed on the photoconductor are smeared and/or distorted by freelyrotatable polyurethane squeegee-rollers used for removing excess developer liquid (German Offenlegungsschrift No. 3,018,241). Thus, although the squeegee-roller technique for reducing the loss of developer liquid has reached a defined, advanced state of development, it nevertheless continues to exhibit shortcomings which prevent it from being widely employed. With copying conditions according to the present state of the art, the successful production of copies with acceptable copy-densities of at least 0.7 and with a correspondingly good resolution of approximately six lines per mm, is not possible.

SUMMARY OF THE INVENTION

An object of the invention is to provide a process and a device for stripping developer from a photoconductive surface in a manner such that good resolution and high copy densities are obtained, while at the same time a substantial reduction in the loss of developer liquid to the copies is achieved.

Another object of the present invention is to provide a device and method for stripping developer liquid from a photoconductor surface which can be implemented with conventionally available components.

A further object of the present invention is to provide a device and method for stripping developer liquid from a photoconductor surface which do not deleteriously affect the life of the electrophotographic device in which they are used.

An additional object of the present invention is to provide a device and method for stripping developer liquid from a photoconductor surface in which streaks and smears on the final copy are avoided.

In accordance with the above and other objects, the present invention includes an electrophotographic copying process comprising electrostatically charging a photoconductor surface to a voltage higher than the charging voltage $U_{maxD}$ defined as the charging voltage required for maximum toner density and exposing the charged photoconductor surface to an information carrying original to form a latent charge image. The latent charge image is developed using a developer liquid to produce a visible toner image by moving said photoconductor surface through a developing station and excess developer liquid is removed from the moving photoconductor surface by contacting said photoconductor surface with an element which rotates at a peripheral speed which exceeds the peripheral speed of said photoconductor surface by up to 20%. The process includes transferring the developed toner image by electrophoresis from the photoconductor surface to an image receiving material under an electric field having a strength which exceeds the field strength required for the transfer of toner images which are developed while the photoconductor surface is charged to the charging voltage $U_{maxD}$, and cleaning the photoconductor surface.

Also in accordance with the above objects, the present invention includes a device for carrying out an electrophotographic copying process, comprising a photoconductor surface and means for moving the photoconductor surface. Means for charging the photoconductor surface to a voltage higher than the charging voltage $U_{maxD}$ defined as the charging voltage required for maximum toner density act on the surface as well as means for exposing the photoconductor surface after charging to an information carrying original to form a latent charge image on said photoconductor surface. A developer means applies developer liquid to the latent charge image to form a developed toner image and an element for removing developer liquid from the photoconductor surface is positioned near the surface. An element moving means moves a surface of the element at a peripheral speed which is 2 to 20% greater than the peripheral speed of the photoconductor surface produced by the photoconductor surface moving means. The device also includes means for forcing the moving element surface against the photoconductor surface and means for transferring the developed toner image by electrophoresis from the photoconductor surface to an image receiving material under an electric field having a strength which exceeds the field strength required for the transfer of toner images which are developed while the photoconductor surface is charged to the charging voltage $U_{maxD}$. After transfer of the image, a means for cleaning the photoconductor surface prepares the surface to make a new copy.

The invention offers the advantage that, by employing measures which are comparatively easy to implement, such as charging the photoconductor surface to a higher voltage, providing a squeegee roller for removing the excess developer liquid, which rotates faster than the photoconductor surface, and transferring the developed toner image from the photoconductor surface onto the image-receiving material by means of a higher transfer voltage, the drag-out of developer liquid can be halved, compared to the state of the art, without making sacrifices with respect to the required copy-quality, although each of these three measures is contrary to the measures conventionally taken.

BRIEF DESCRIPTION OF THE DRAWINGS

In the following text, the invention is described in greater detail, reference being made to the accompanying drawings, in which.

DETAILED DESCRIPTION OF THE PREFERRED EMBODIMENT

Generally, in known copying processes, a photoconductive layer is charged and then exposed to form a charge image. The charge image is developed by means of charged toner particles which are dispersed in a developer liquid and excess developer liquid is removed from the photoconductive layer by rollers. The toner image is then transferred onto an image-receiving material, such as sheets of paper. Thereafter, the photoconductive layer is cleaned for the next copying cycle and, if appropriate, is discharged. The photoconductors are either applied to supports in the form of webs which are composed, for example, if thin sheets of polyester with a conductive coating of vapor-deposited aluminum, or they are vapor-deposited onto the cylindrical surfaces of metal drums. The flexible webs are, for the most part, coated with resilient, organic photoconductive coatings composed of poly-N-vinylcarbazole and trinitrofluorenone. Although webs may be used, more frequently, copiers are equipped with conductive drums made of aluminum, onto which the photoconductive coating is vapor-deposited. In addition to organic photoconductive layers, inorganic photoconductors such as selenium, or selenium/tellurium alloys, or selenium/arsenic alloys may be employed on the drums. In the following text, the invention will be described primarily by reference to photoconductive layers composed of selenium, or of selenium/tellurium or selenium/arsenic alloys. This does not represent any limitation of the concept of the invention, this concept being equally valid for organic photoconductors.

Figure 1:
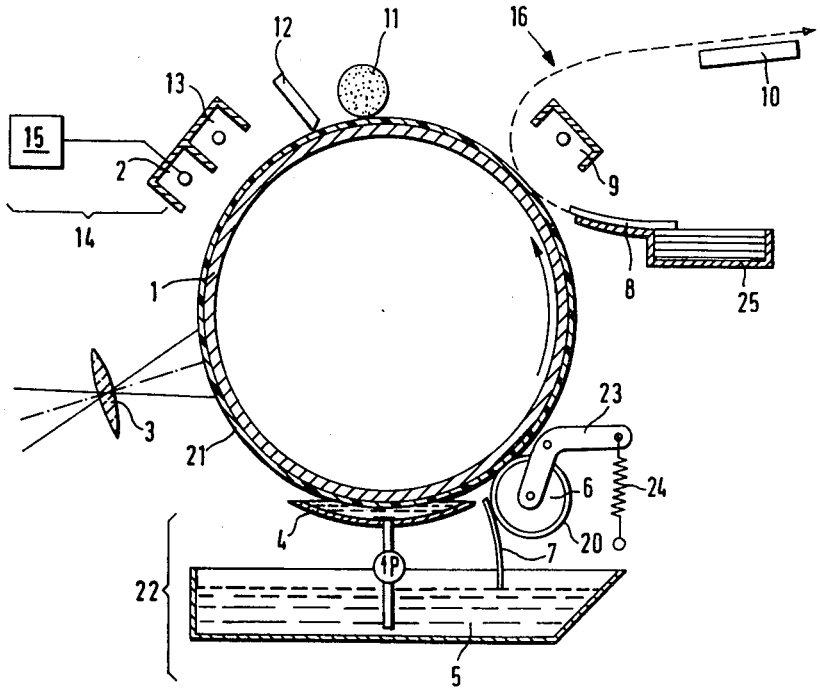
FIG. 1 shows a diagrammatic side view of an electrophotographic copier for carrying out the process according to the invention.

The construction of a copier with which the process according to the present invention can be carried out corresponds to the known state of the art and is diagrammatically represented in FIG. 1. A drum 1 is provided with a photoconductor 21, and is caused to rotate counterclockwise (viewed in FIG. 1) at a preset speed by a drive source which is not represented. There are arranged around the periphery of the drum 1: an electrical charging unit 2 which can be a corona, an exposing station 3, a developing station 22, a stripping roller 6 for excess developer liquid, an image transfer station 16, a cleaning device 11, 12, and a further charging unit 13, which can be an alternating-current corona and/or a neutralizing lamp.

If the photoconductor 21 is composed of an organic material, for example of poly-N-vinylcarbazole/trinitrofluorenone, it is negatively charged by the electrostatic charging unit, while positive charges are applied if the photoconductor 21 is composed of selenium. In the exposing station 3, the charged photoconductor 21 is exposed such that information is projected onto it by an optical system; i.e. it is exposed to a ray-image of an original. The electrostatic, latent charge image obtained in this manner is developed in the developing station 22, by means of a developer liquid to produce a visible toner-image. The developing station 22 comprises an arcuated plate 4, the curvature of which is matched to that of the peripheral surface of the drum 1, and a trough 5, which is filled with the developer liquid. The plate 4 serves as a developing electrode, and a defined voltage is applied to it by mean of a voltage source which is not shown. It is also possible to provide a roller instead of the arcuate plate 4. In the case of organic photoconductive layers, the toner particles dispersed in the developer liquid are positively charged, while they are negatively charged in the case of selenium layers. Most of the excess, projecting developer liquid is removed by the stripping device which comprises the roller 6, with a scraper 7.

At the transfer station 16, an image-receiving material, for example a sheet 8 of paper, is fed from a container 25 to the drum 1. The transfer station 16 includes a charging unit 9, for example a corona, which charges the sheet 8 of paper from the rear electrostatically. In the case of a selenium photoconductor 21, the sheet 8 of paper is positively charged. It is also possible to provide a pressure roller (not shown) instead of the charging unit 9. This pressure roller bears against the peripheral surface of the drum 1 and is connected to a voltage source which charges it to a potential suitable for the transfer operation. Following the transfer of the toner-image from the photoconductor 21 onto the sheet 8 of paper, the sheet 8 is detached from the peripheral surface of the drum 1 and is drawn over a heating device 10, which dries the still moist toner-image.

The cleaning device comprises a roller 11, for example a roller made of a foamed material, and a wiper-blade 12, which is located in the immediate vicinity of the roller 11. The roller 11 is wetted with developer liquid and, together with the wiper-blade 12, cleans toner residues from the surface of the photoconductor.

The charging unit 13 removes all residual charges from the photoconductor 21, so that the latter is completely discharged.

In known copiers, when the photoconductor 21 is selenium, an operating voltage of +6.5 kV is supplied to the direct-current corona 2. The photoconductive layer of selenium, which is approximately 50 μm thick and has been charged to a maximum of about +1,150 V, is discharged in accordance with the quantity of light supplied in the exposing station 3. Toner particles are then deposited corresponding to the residual charge which is present on the photoconductive coating, whereby the latent charge-image is developed into a toner-image.

The charging unit 14 comprises the direct-current corona 2. This corona is connected to a high-voltage circuit 15 which is designed to continuously operate the direct-current corona 2 at a voltage of 8 kV. The element for removing the developer liquid from the surface of the photoconductor 21 is preferably a squeegee-roller 6 rotating at a peripheral speed which exceeds the speed at which the drum 1 rotates by 2 to 20%. The squeegee-roller stands in line-contact with the photoconductor 21, and is pressed against the photoconductor surface of the drum 1 at a linear pressure equal to or exceeding 0.5 N/cm, by means of an angle-shaped lever 23 and a tension spring 24 acting on one of the ends of the angle-lever. The other end of the angle-shaped lever 23 is coupled to the shaft of the squeegee-roller 6. The lever can be pivoted about a fulcrum. The linear pressure between the squeegee-roller 6 and the photoconductor surface of the drum 1 can also amount to 1 to 3 N/cm, depending on the choice of the spring 24. A resilient wiper-blade 7 contacts the surface of the squeegee-roller 6, and strips excess, projecting developer liquid from the peripheral surface of the roller.

Figure 2:
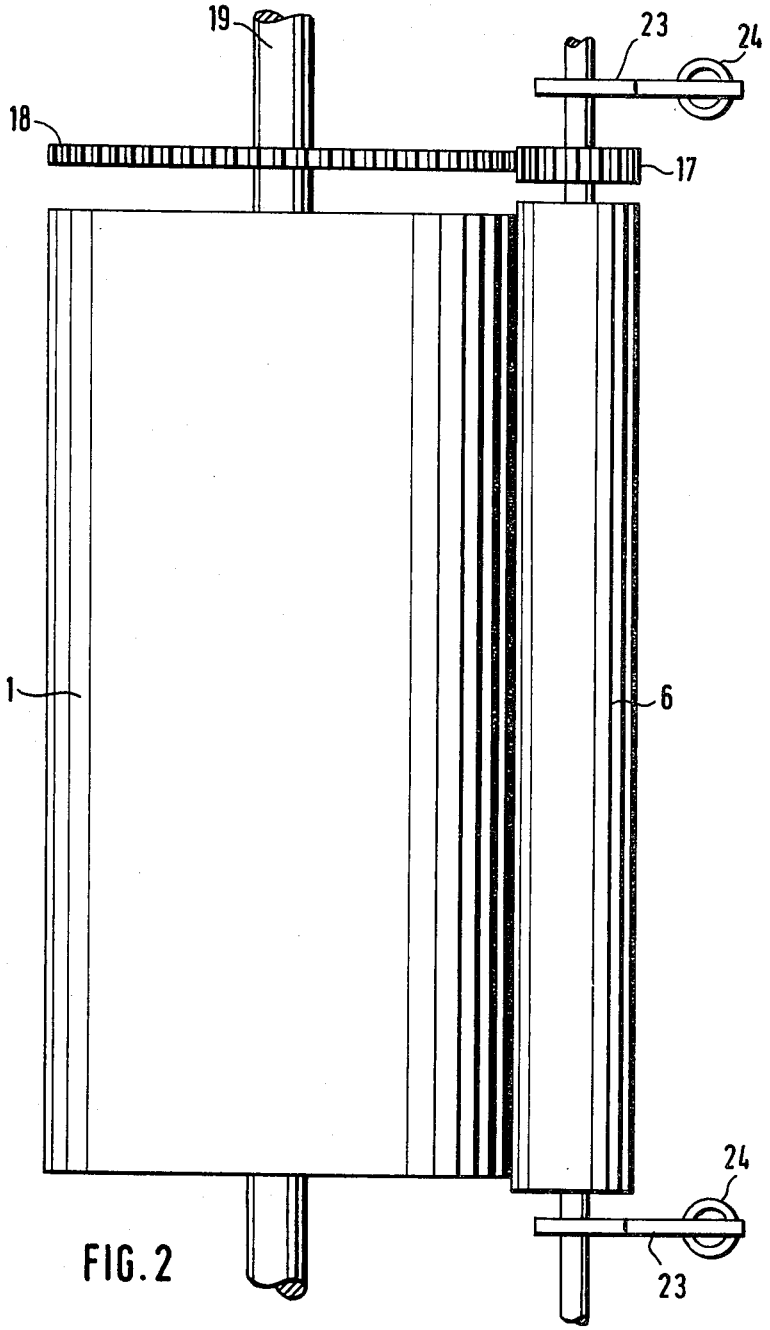
FIG. 2 shows a view of a gearwheel-drive, which, via the photoconductive drum, causes the squeegee-roller of the copier shown in FIG. 1 to move.

As FIG. 2 shows, the squeegee-roller 6 is longer than the photoconductor drum 1 and projects beyond the end faces of the photoconductive drum 1. It is also possible for the squeegee-roller to project beyond the end face of the photoconductive drum only at one side. This latter embodiment is not shown in the drawing, however.

The squeegee-roller 6 is composed of a metal core and a resilient covering 20, the latter having a thickness of 4 to 8 mm. The covering material has a Shore-A hardness of 25 to 60. In a preferred embodiment, the material forming the covering 20 is polyurethane to which iron oxide has been added, and possesses a Shore-A hardness of 27. It is essential that the surface of the covering 20 is smooth and that irregularities which may be present thereon do not exceed 2 μm. Irregularities smaller than 1 μm, however, are preferred. A covering 20 possessing a smooth surface of this nature can be produced by casting.

As can be seen from FIGS. 1 and 2, two angle-shaped levers 23 are pivotally mounted, respectively, at the end faces of the squeegee-roller 6. The squeegee-roller 6 is in engagement, via a gearwheel-drive 17, with a gearwheel 18 which seats on the shaft 19 of the drum 1. The transmission ratio between the gearwheel-drive 17 and the gearwheel 18 is chosen such that the peripheral speed of the squeegee-roller 6 exceeds that of the drum 1 by approximately 2 to 20%, and such that the squeegee-roller 6 and the drum 1 are driven in the same direction in the contact region.

Figure 3A:
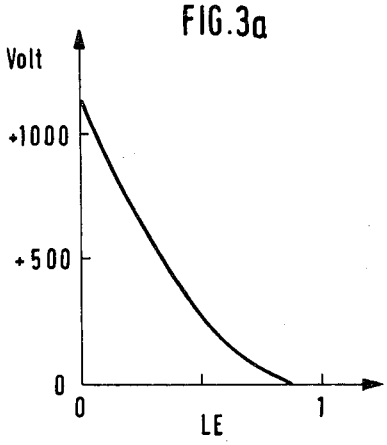
FIGS. 3*a* and 3*b*, respectively, show graphically the variation of the voltage at the photoconductor surface, and the copy-density as a function of the luminous energy incident on the photoconductor, in relative units, when conventional copying conditions prevail at the photoconductor.

A discussion of the copying conditions prevailing in conventional developing processes will now be set forth with reference to FIGS. 3*a* and 3*b*. FIG. 3*a* shows the potential, in volts, of a selenium photoconductor as a function of the luminous energy LE incident thereon, this energy being indicated in relative units. The specific charge, i.e. the voltage per unit thicknes of the photoconductive layer is 23 V/μm. The voltage varies inversely, in an exponential manner, with the incident luminous energy, i.e. the greater the incident luminous energy, the greater is the extent to which the photoconductive coating is discharged.

Figure 3B:
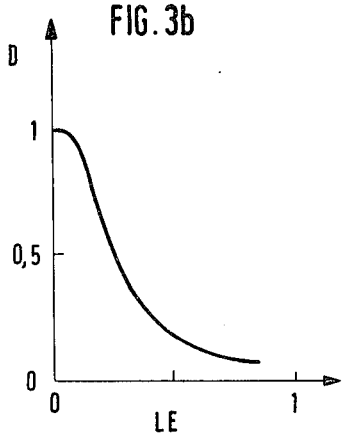

In FIG. 3*b*, the toner-densities on the copies produced, corresponding to the voltage values from FIG. 3*a*, are plotted as a function of the incident luminous energy LE, once again represented in relative units. The toner-density D is defined as the logarithm of the ratio of the quantity of incident light to the quantity of light reflected onto the copy from the developed toner-image.

As a comparison of the shapes of the curves in FIGS. 3*a* and 3*b* shows, a maximum density of 1 is obtained at a voltage of only +850 V, the compensated residual voltage being +150 V. At lower voltages, lower-density toner-images are developed. In order to allow for the effect of a discharge occurring in the dark during the time the charge image runs from the charging unit to the exit from the developing station, it is necessary to charge the photoconductor to a voltage somewhat higher than the theoretical value to achieve the maximum density of 1. In the case of the graphs according to FIGS. 3*a* and 3*b*, this charge amounts, for example, to +1,150 V. In the text which follows, the charging-point for maximum toner density $U_{maxD}$ is designated as the photoconductor charging-voltage which, without being discharged by exposure, yields copies which possess a maximum density equal to 1, under the particular operating conditions which prevail.

Under normal copying conditions, there is no incentive to charge the photoconductive layers to values which are noticeably higher than the charging point for maximum toner-density. On the contrary, it has been observed that if the charge exceeds this point, the toner density of the copies decreases, and intermediate shades of the original are reproduced as full shades on the copy. A displacement or reversal, of the toner values of this nature, cannot be tolerated in copies which are produced commercially.

Figure 4A:
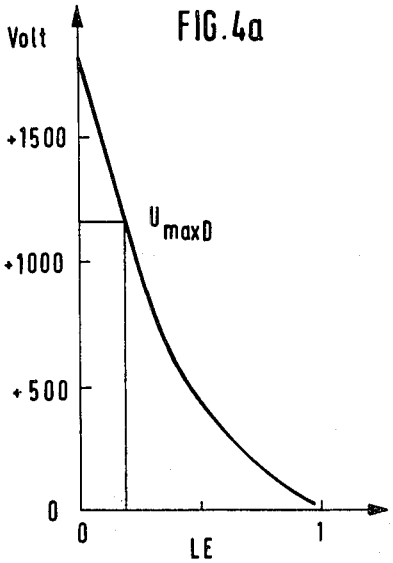
FIGS. 4*a* and 4*b*, respectively, show graphically the variation of the voltage at the photoconductor surface, and the copy-density as a function of the luminous energy incident on the photoconductor, in relative units, when copying conditions according to the present invention prevail at the photoconductor surface.
Figure 4B:
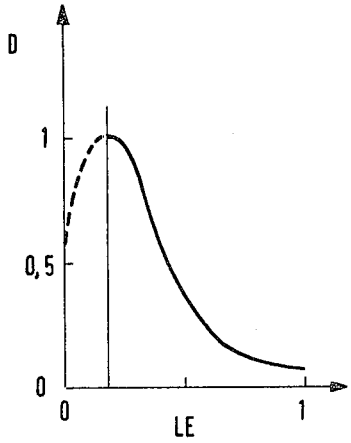

FIGS. 4*a* and 4*b* represent the voltage values associated with the exposure of a photoconductive layer which has been charged to +8 kV, and the corresponding copy-densities, as functions of the incident luminous energy LE, once again measured in relative units. As can be seen, especially from FIG. 4*b*, the copy density decreases when the charge exceeds the charging-point for maximum toner density $U_{maxD}$.

Contrary to these results, which were obtained under the conventional copying conditions of the known developing processes, it has been found that when the charging voltage exceeds $U_{maxD}$, the toner density remains constant, i.e. does not fall as shown in FIG. 4*b*, when the excess, projecting developer liquid on the photoconductor surface is removed either by means of a roller positioned a short distance away from and rotating in the opposite direction as the photoconductor, or by means of a resilient squeegee-roller 6, which rotates in the same direction as the photoconductor surface and is pressed against it. As a result, it is possible to avoid the fundamental disadvantage of using squeegee-rollers which are pressed against the surface, namely the reduction in the copy-density through the action of the squeegee-roller. However, if no further precautions were taken, the toner-density associated with charging the photoconductive layer to voltages exceeding $U_{maxD}$, produces a copy-density which is somewhat less than the maximum copy-density. This reduced density of the copies can be compensated by employing a higher transfer-voltage in the transfer station 16 of FIG. 1. For this purpose, the voltage at the direct-current corona 9 in the transfer station 16 is raised from the customary +6.3 to 6.5 kV, to +7.5 kV in the copier according to FIG. 1. If the transfer station operates with the aid of a transfer-roller, instead of a transfer-corona, it is accordingly necessary to increase the potential of this roller by a corresponding amount.

In the process according to the present invention, the squeegee-roller 6 can be guided over the photoconductive layers without having an adverse effect on the toner-images present on these layers as long as the charging voltage exceeds approximately 1,300 V, i.e. the specific voltage exceeds 26 V/μm. Care has to be taken that the photoconductive coatings are not so highly charged that dielectric breakdown occurs in the photoconductive layers. For example, it is possible to charge 50 μm thick selenium photoconductive layers to approximately +1,800 V (equivalent to 36 V/μm) without dielectric-breakdown effects, and 65 82 m thick photoconductive layers composed of a selenium/tellurium alloy, can be charged to approximately +2,500 V (equivalent to 38 V/μm).

In order to improve the resolution of the copies which are produced in this manner, and leave the copies in a substantially dry condition, background-free and rich in contrast, the squeegee-roller 6 should rotate at a speed which exceeds that of the drum in the contact region with the drum 1. This higher rotation speed prevents areas and lines from exhibiting slightly jagged borders at their rear edges at right-angles to the direction of running. These jagged borders limit the resolution capacity in this direction to approximately 2.8 lines/mm. These finely jagged borders are composed, in all probability, of toner particles which have been removed by the squeegee-roller 6. Contrary to the teachings in German Offenlegungsschrift No. 3,018,241, that the speed of the squeegee-roller relative to the photoconductive drum should be zero, it has been found that the removal of toner particles by the squeegee-roller is actually prevented when this roller is moved at a speed which is approximately 2 to 20% higher than the speed of the photoconductor in the region of contact with the photoconductor. The optimum speed range is approximately 2 to 12% higher than the photoconductor speed. This speed difference improves the resolution at right angles to the direction in which the drum 1 and the squeegee-roller 6 run to 5 to 6.3 lines/mm.

As mentioned above, the squeegee-roller 6 is equipped with a resilient covering composed of a solvent-resistant material, such as polyurethane. This covering seats on a metal roller-core. The covering material is resilient, and possesses a Shore-A hardness of 25 to 60, and more optimally, a hardness not exceeding 35. It proves advantageous, for low loss of developer liquid, to select a covering-thickness in the range from 4 to 8 mm. In the case of covering-thicknesses exceeding 8 mm, a Shore-A hardness of less than 30, for example 27, is specified.

The conductivity of the squeegee-roller 6 has no noticeable effect on the copy-quality. In the process according to the present invention, no potential of a defined magnitude is applied to the squeegee-roller 6; on the contrary, the metal core of the squeegee-roller 6 is generally connected to ground. The wiper-blade 7 is made of plastic or metal and serves to clean the squeegee-roller 6. This blade lies flat against the surface of the squeegee-roller 6.

The application of a uniformly powerful contact pressure by the squeegee-roller 6 over the entire width of the photoconductor-surface of the drum 1 is essential in order to achieve an effective reduction in the rate at which developer liquid is lost to the image receiving material.

It has been determined in tests that an increase in the pressure in the linear contact region at which the squeegee-roller 6 contacts the photoconductor surface from 0.43 N/cm to 3.3 N/cm reduces the loss of developer liquid to the image receiving material by 30%.

In the process according to the present invention, it is necessary to form the surface of the squeegee-roller 6 in a manner such that it is as smooth as possible. The rate at which developer liquid is lost is considerably increased by surface textures having heights of a few microns only. For example, the quantities of developer liquids which are lost to the copies in the case of textures having heights of 5, 7 and 9 μm, corresponds to the ratios 1:1.3:1.8. For this reason, use is made of squeegee-rollers with surfaces textures having heights of less than 2 μm, or even less than 1 μm. In order to manufacture smooth rollers of this type from a resilient material, it is necessary to cast them in polish casting-molds or to manufacture the squeegee-rollers by hot-calendering their surfaces. It is possible to produce smooth roller-surfaces in resilient materials by turning, grinding and polishing; but, only by very laborious and difficult procedures.

As has already been mentioned in connection with FIG. 2, the squeegee-roller 6 projects beyond the two ends faces of the drum 1, or at least beyond one of these end faces, in order to avoid the production of moist black borders at the edges of the the copies. If, in fact, the squeegee-roller 6 ends flush with the photoconductor 21, that is to say if the squeegee-roller 6 and the drum 1 are equally wide, moist, black borders occur at the edges of the copies in the direction of running. The borders remain dry and clean when a squeegee-roller 6 which is a few millimeters wider than the drum 1 is used. A lateral overhang of the squeegee-roller 6, of 2 to 5 mm, is adequate for applications under practical conditions. If the squeegee-roller 6 is markedly wider than the copy, or, respectively, than the drum 1, it is sufficient if the squeegee-roller projects at that side on which the copy sheet is placed.

In the text which follows, an illustrative embodiment of the invention is described in detail.

The result cited below is obtained with a squeegee-roller 6, which has a cast polyurethane covering which is 8 mm thick and has a Shore-A hardness of 27. The squeegee-roller 6, which is 29.5 cm long, is pressed against the drum 1 in the line-contact with the photoconductive layer at a pressure of 2 N/cm, and is driven at a peripheral speed which exceeds that of the drum 1 by 5%. A selenium/tellurium alloy is used as the photoconductor, the photoconductor has a thickness of 65 μm and is charged to +2,410 V by the direct-current corona 2, which is supplied with +8 KV. The liquid toner is composed of a developer liquid such as, e.g. Isopar L, an isoparaffinic hydrocarbon possessing a boiling-point of 192° C., and an Infotec® toner. Background-free copies are obtained which exhibit a density of 1.1 to 1.2 in the full-shade areas. The resolution in the direction of running is not less than 6.3 lines/mm and is 5 to 6 lines/mm at right angles to the direction of running. At a somewhat lower density of 0.9 to 1.0, the resolution at right angles to the direction of running is likewise 6.3 lines/mm.

In order to determine the loss of developer liquid to the copies, the total consumption of liquid developer is determined by weighing the trough 5 of the developing station 22 at the beginning of the measurement and after each 6,000 copies. This weight-difference is reduced by the weight of developer liquid which escapes as a result of evaporation in the copier itself, when the latter is operated without a supply of copier-paper.

On copying a completely white original, without information, the loss amounts to approximately 0.002 g of Isopar L per DIN A4 copy. Such a copy is completely dry.

On copying a white original by a prior art process using a roller rotating counter to the photoconductor at a peripheral speed of up to three times that of the photoconductor and with a small clearance of only 35 μm, the loss amounts to approximately 0.118 g of Isopar L per DIN A4 copy. These copies are moist, and have to be dried in a fixing station by means of a heating element.

On copying an original with a coverage of approximately 7%, which is typical of pages carrying typescript, the loss values for copies produced according to the present process are approximately 0.013 g of Isopar L per DIN A4 page, while 0.129 g of Isopar L is lost to each DIN A4 copy produced in accordance with the state of the art, i.e. an amount approximately ten times as great.

In the case of an original with a coverage of 7%, a portion of developer liquid approximating to 0.01 g per DIN A4 copy appears to be the smallest quantity of developer liquid which is required in the process according to the present invention in order to impart a pasty consistency to the toner particles which are deposited on the photoconductor. This pasty consistency is required for the transfer process into the image-receiving material.

A long-term test, in accordance with the technique described above, was run for a period of several weeks, during which test more than 60,000 copies were developed. During this time, the squeegee-roller 6 remained continuously in contact with the drum 1. After termination of the long-term test, the squeegee-roller 6 exhibited no traces of abrasion or striations, or any other impressions. The mechanical wear of the photoconductive layer on the drum 1, was less or, at most, equal to the wear suffered by a photoconductive drum operated according to a conventional copying process. After 60,000 copies, the maxium peak-to-valley roughness is approximately 2.4 μm.

In the course of copying, the photoconductive layer generally ages in a manner such that the maximum charging level declines as a function of time. In the case of the increased corona voltage of +8 kV which is used this aging effect manifests itself in a more pronounced manner than in the case of the customary corona voltage of +6.5 kV. The charging level declines from 2,350 V to approximately 1,650 V at the end of the long-term test. Overall, it is possible to state that charging the photoconductive layer to higher voltages does not subject it to more severe conditions than the comparatively low-voltage charging in the case of the conventional copying processes.

On starting up the copier following a relatively long shutdown, no disturbances occur during the process of switching the copier on, although the squeegee-roller is continuously in contact with the photoconductive coating. This is attributable, in all probability, to the fact that undried toner residues are easily rinsed from the very smooth surface of the squeegee-roller 6, and are redispersed.

In addition to conventional copying-papers with smooth surfaces, rougher papers were also tested. The copies produced from these papers show slight graining in the full-shade and in the lines, but the degradation in the quality is less than on copies which are produced with these types of paper in accordance with a prior art process.

What is claimed is:

1. An electrophotographic copying process, comprising:

electrostatically charging a photoconductor surface to a voltage higher than the charging voltage $U_{maxD}$ defined as the charging voltage required for maximum toner density;

exposing the charged photoconductor surface to an information carrying original to form a latent charge image;

developing the latent charge image using a developer liquid to produce a visible toner image by moving said photoconductor surface through a developing station;

removing excess developer liquid from said moving photoconductor surface by contacting said photoconductor surface with an element which rotates at a peripheral speed which exceeds the peripheral speed of said photoconductor surface by up to 20%;

transferring the developed toner image by electrophoresis from the photoconductor surface to an image receiving material under an electric field having a strength which exceeds the field strength required for the transfer of toner images which are developed while the photoconductor surface is charged to the charging voltage $U_{maxD}$; and cleaning the photoconductor surface.

2. The process as claimed in claim 1, wherein the photoconductor surface comprises selenium and the step of electrostatically charging comprises charging said photoconductor surface to a voltage in excess of 1,300 volts.

3. The process as claimed in claim 1, wherein the photoconductor surface comprises selenium and the step of electrostatically charging comprises charging said photoconductor surface to a specific charge in excess of 25 V/μm, the specific charge being the voltage per unit thickness of the photoconductor surface.

4. The process as claimed in claim 3, wherein the photoconductor surface is charged to a specific charge of less than 36 V/μm.

5. The process as claimed in claim 2, wherein the photoconductor surface has a thickness of 50 μm and is charged to a voltage of less than 1,800 volts.

6. The process as claimed in claim 1, wherein the step of transferring the toner image from the photoconductor surface to the image-receiving material, is carried out at a transfer-voltage of 7.5 kV to 8 kV.

7. The process as claimed in claim 1, wherein the step of removing excess developer comprises using a squeegee-roller rotating at a peripheral speed which exceeds the speed of the photoconductor surface by 2 to 12%.

8. The process as claimed in claim 7, wherein the squeegee-roller is positioned in line contact with the photoconductor surface, and the squeegee-roller is forced against the photoconductor surface with a pressure of at least 0.5 N/cm.

9. The process as claimed in claim 8, wherein the squeegee-roller is forced against the photoconductor surface with a pressure of 1 to 3 N/cm.

10. The process as claimed in claim 7, including the step of cleaning the squeegee-roller by a wiper blade.

11. A device for carrying out an electro-photographic copying process, comprising:

a photoconductor surface;

means for moving said photoconductor surface;

means for charging said photoconductor surface to a voltage higher than the charging voltage $U_{maxD}$ defined as the charging voltage required for maximum toner density;

means for exposing said photoconductor surface after charging to an information carrying original to form a latent charge image on said photoconductor surface;

means for applying developer liquid to said latent charge image to form a developed toner image;

an element for removing developer liquid from said photoconductor surface;

means for moving a surface of said element at a peripheral speed which is 2 to 20% greater than the peripheral speed of said photoconductor surface produced by said photoconductor surface moving means;

means for forcing said moving element surface against said photoconductor surface;

means for transferring said developed toner image by electrophoresis from the photoconductor surface to an image receiving material under an electric field having a strength which exceeds the field strength required for the transfer of toner images which are developed while the photoconductor surface is charged to the charging voltage $U_{maxD}$; and means for cleaning said photoconductor surface.

12. The device as claimed in claim 11, wherein said element comprises a squeegee-roller with a resilient covering having a smooth surface with irregularities which are smaller than 1 μm, and which do not exceed 2 μm.

13. The device as claimed in claim 12, wherein the covering has a thickness of 4 to 8 mm and a Shore-A hardness of 25 to 60.

14. The device as claimed in claim 12, wherein the thickness of the covering exceeds 8 mm and the Shore-A hardness does not exceed 35.

15. The device as claimed in claim 12, wherein the squeegee-roller is a casting.

16. The device as claimed in claim 15, wherein the material forming the covering of the squeegee-roller is polyurethane to which iron oxide has been added, and possesses a Shore hardness of 27.

17. The device as claimed in claim 12, wherein the photoconductor surface is formed on a drum and the squeeges-roller is longer than the drum and projects, at least at one side, beyond an end face of the drum.

18. The device as claimed in claim 11, wherein said photoconductor surface is formed on a drum and said element is a roller and further including means connected between said drum and said roller to produce relative rotation for causing the peripheral speed of said roller to be 2 to 20% greater than the peripheral speed of said photoconductor surface on said drum.

19. The device as claimed in claim 11, wherein said charging means comprises a corona and a high voltage circuit for supplying 8 kV to said corona.

20. The device as claimed in claim 11, wherein said transfer means comprises a direct current corona having an operating voltage of 7.5 kV to 8 kV.

21. The device as claimed in claim 11, wherein the photoconductor surface is selenium and $U_{maxD}$ equals 1,300 volts.

22. The device as claimed in claim 11, wherein said photoconductor surface is 50 $\mu$m thick.

23. The device as claimed in claim 11, wherein said element is disposed between said developer station and said transistor station.

* * * * *